US008393503B2

(12) United States Patent
Moscato

(10) Patent No.: US 8,393,503 B2
(45) Date of Patent: Mar. 12, 2013

(54) SELF-OPERATED DEVICE FOR THE DISABLED FOR PUTTING ON STOCKINGS OR SOCKS AND SIMILAR GARMENTS

(76) Inventor: Giuseppe Moscato, Rome (IT)

( * ) Notice: Subject to any disclaimer, the term of this patent is extended or adjusted under 35 U.S.C. 154(b) by 121 days.

(21) Appl. No.: 13/000,190

(22) PCT Filed: Jun. 18, 2009

(86) PCT No.: PCT/IT2009/000267

§ 371 (c)(1),
(2), (4) Date: Dec. 20, 2010

(87) PCT Pub. No.: WO2009/153825

PCT Pub. Date: Dec. 23, 2009

(65) Prior Publication Data

US 2011/0101046 A1 May 5, 2011

(30) Foreign Application Priority Data

Jun. 20, 2008 (IT) ..... RM2008A0327

(51) Int. Cl.
*A47G 25/90* (2006.01)

(52) U.S. Cl. ..... 223/112

(58) Field of Classification Search ..... 223/111–119
See application file for complete search history.

(56) References Cited

U.S. PATENT DOCUMENTS

| | | | | |
|---|---|---|---|---|
| 4,756,453 | A * | 7/1988 | Pettit et al. | 223/111 |
| 4,991,757 | A * | 2/1991 | Deakyne | 223/112 |
| 5,706,988 | A * | 1/1998 | Moore | 223/111 |
| 5,826,761 | A * | 10/1998 | Basaj | 223/112 |
| 6,932,252 | B2 * | 8/2005 | Simmons | 223/111 |
| 7,234,616 | B2 * | 6/2007 | Thom et al. | 223/112 |
| 2003/0230605 | A1 | 12/2003 | Simmons | |

FOREIGN PATENT DOCUMENTS

| | | |
|---|---|---|
| DE | 1021148 | 12/1957 |
| EP | 1674005 | 6/2006 |
| GB | 2221604 | 2/1990 |
| GB | 2296421 | 7/2004 |
| JP | 2004195108 | 7/2004 |
| WO | 2008006142 | 1/2008 |

OTHER PUBLICATIONS

International Search Report issued in the PCT application on Nov. 5, 2009.

* cited by examiner

*Primary Examiner* — Nathan Durham
(74) *Attorney, Agent, or Firm* — Young & Thompson

(57) ABSTRACT

The device allows individuals suffering from a reduced physical mobility to easily put on socks (C) and stockings, previously inserted onto a special widener (1) that will maintain the garments in open position by way of appropriate hooking elements (4, 5). The user will be able to insert his own foot inside the sock or the stocking, and by sliding his limb inside the widener (1), he will be able to put on the garment without any strain. Once the user has finished dressing, special tension ribbons (6), connected to the hooking elements (4, 5), allow the release of the garments from the widener. The use of the device is made possible by handles (7), linked to telescopic rods (8) whose length is fixed or adjustable according to the height of the user, hinged onto joints (9) or equivalent elements connected to the widener by pins (10) or equivalent elements.

6 Claims, 2 Drawing Sheets

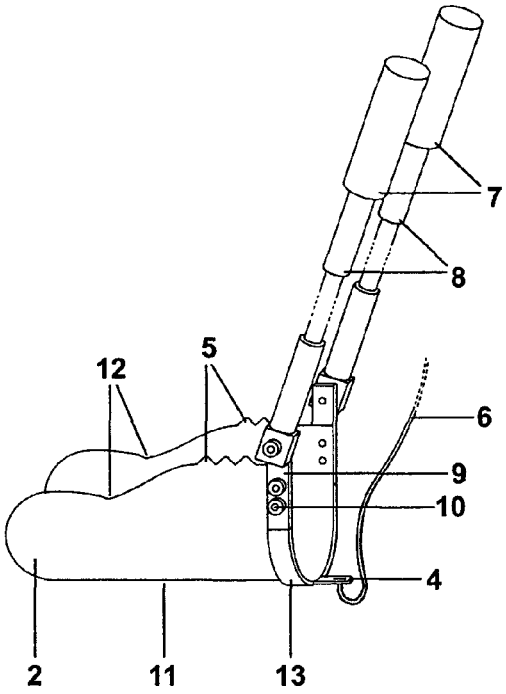
FIG. 4
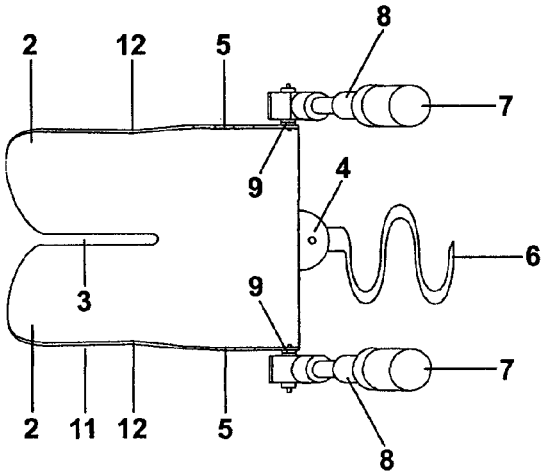
FIG. 5
FIG. 6
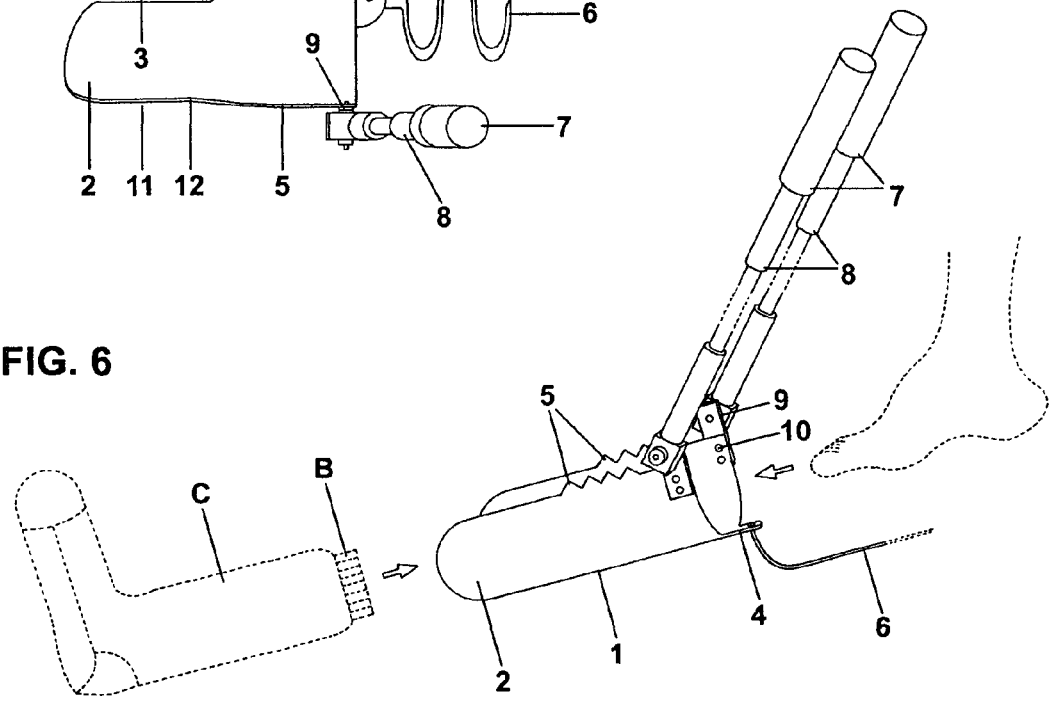

SELF-OPERATED DEVICE FOR THE DISABLED FOR PUTTING ON STOCKINGS OR SOCKS AND SIMILAR GARMENTS

BACKGROUND OF THE INVENTION

1. Field of the Invention

The present invention concerns the field of medical aid devices for persons with temporary or permanent motorial handicaps.

More in detail, the present invention concerns a device that allows individuals suffering from a reduced physical mobility to put on easily and without strain garments like socks, elastic or non-elastic stockings, tights or the like.

2. Description of the Related Art

It is well known that to persons suffering from either temporary or permanent motorial handicaps, obesity, back from surgical operations, or simply elderly people, the easy gesture of correctly putting on a sock or more generally a stocking may be an insurmountable problem.

It is the aim of the present invention to realize a device that can be operated autonomously by the disabled, that assists him while putting on socks, stockings or similar garment, sparing him to bend his bust or to bend his lower limbs.

In a previous patent filed under no. RM1993A000774 on Nov. 23, 1993 in the name of the same applicant, a device is described for responding to above mentioned needs.

However, said device provided a non optimal functioning level, strongly depending on the elasticity of the different fabrics used for making garments like socks and stockings in general, and it could not be used for putting on containing stockings with a high compression factor.

BRIEF SUMMARY OF THE INVENTION

It is the aim of the present invention to solve above mentioned inconveniences by means of a self-operated device for the disabled for putting on stockings or socks and similar garments, characterized in that it comprises:

- a widener (1, 11) of an approximately semicylindrical shape, onto which socks (C), stockings and similar garments can be put and kept in open position;
- hooking means (4, 5) for strengthening the hold of said widener (1) on the garments applied thereto, respectively placed in the back part of the widener (1) and above the lateral walls of the same;
- handles (7) allowing the use of the device according to the present invention, linked to stiff rods (8) hinged on joints (9) or other equivalent means connected by means of pins (10) or other equivalent means to said widener (1).

The advantages of the device according to the present invention are many and important:

- it allows to correctly put on, without great physical strain, garments like socks and stockings in general, elastic and containing stockings (18-22 mm Hg), tights (using two devices according to the present invention at the same time), etc.:
- it gives back autonomy to persons suffering from a reduced physical mobility;
- it is easy to be used and does not require particular servicing.

The present invention will be described more in detail herein below with the help of the enclosed drawings in which some embodiments are shown.

BRIEF DESCRIPTION OF THE DRAWINGS

FIGS. 4, 5 show a complete axonometric and plant view of a realization variant of the device according to the present invention, so as to enable people to put on stockings, socks in general or containing elastic stockings.

FIG. 6 shows, in axonometric scheme, the functioning principle of the device according to the present invention.

DETAILED DESCRIPTION OF THE PREFERRED EMBODIMENTS

Figure 1:
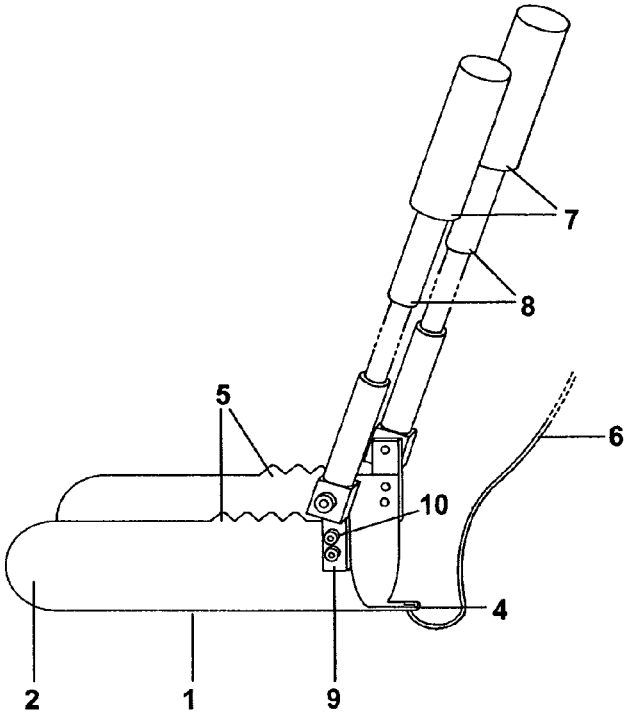
FIGS. 1, 2 show a complete axonometric and plant view of a self-operated device for the disabled for putting on socks or stockings in general, according to the present invention.
Figure 2:
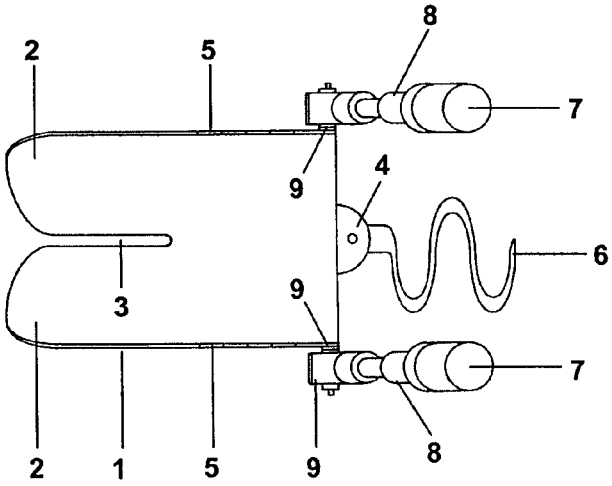
Figure 3:
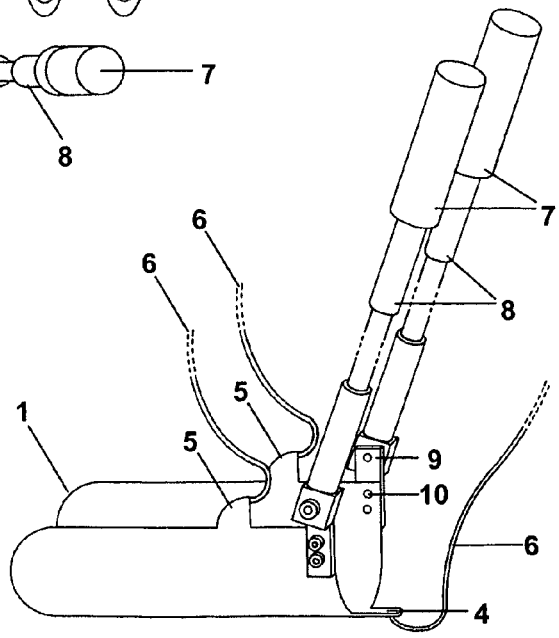
FIG. 3 shows a complete axonometric view of a shape variant of the device according to the present invention.

Relating now to the details of the figures, the self-operated device for the disabled for putting on socks or stockings in general, according to the present invention, mainly consists of:

- a widener 1 of approximately semicylindrical shape, onto which it is possible to put and keep in open position socks C, stockings or similar garments, provided with rounded top ends 2 for facilitating said operation, together with one or more lateral slits 3 further increasing the overall flexibility of the element;
- hooking means 4, 5 for strengthening the hold of the widener 1 onto socks C or stockings in general applied to the same, respectively placed in the back part of said element and on top of its lateral walls;
- one or more tension ribbons 6 determining the detaching of the garments from said widener 1, connected to back hooking means 4 and, optionally, to upper hooking means 5;
- handles 7 allowing the use of the device according to the present invention, linked to stiff rods 8, whose structure is fixed or alternatively telescopic in order to make them adjustable, according to the height of the user, hinged onto joints 9 or other equivalent means and connected to said widener 1 by means of pins 10 or other equivalent means.

According to the present invention, the user can adjust the stiff rods 8 if they are of the telescopic type so as to reach the ends of his own lower limbs with the widener 1, i.e. without bending, the user will pull the sock C, or the stocking in general, onto said widener, securing the upper edge B thereof to the special hooking means 4, 5 and inserting between the upper edge of the garment and said hooking means 4, 5 a part of the tension ribbons 6 connected thereto.

Then, grasping the device according to the present invention by the special handles 7, and without bending, the user will insert his own foot inside sock C or inside a stocking in general, maintained in open position by the widener 1 and, making his limb slide inside said widener, he will be able to put on the garment without any strain.

Said widener 1 rotates on the telescopic rods 8, that are hinged to joints 9 applied to said widener by means of pins 10, and can autonomously assume, under the push of the limb inserted into the same, a position that facilitates the correct dressing of the garment applied to it.

Operating onto said tension ribbons 6, the user of the device according to the present invention will release the sock C or the stocking in general, which is now correctly put on, from the hooking means 4, 5 holding it connected to said widener 1, and he will take off the device from the garment appropriately moving it by means of said handles 7.

Said hooking means 4, 5 may be realized in different shapes, dimensions and number so as to suit the functioning of the device according to the present invention to the different consistence of the fabrics out of which socks, elastic or non elastic stockings, tights and similar garments are usually made of.

In presence of pathologies requiring the use of containing elastic stockings, with even an high compression factor, the device according to the present invention may be provided with an alternative widener 11, characterized in special shapes 12 for strengthening the hold on the mentioned garments and determining the opening of the upper edge B of the same.

A reinforcing element 13 applied to said widener 11 or integrated into the structure of the same, prevents it from suffering deformations due to the stocking applied thereto which might compromise the correct sliding of the foot inside the same and thus the correct dressing of the garment.

Materials, shape and details can be different form those described above, still remaining within the scope of the invention.

The invention claimed is:

1. A self-operated device for the disabled for putting on stockings or socks and similar garments, comprising:

a widener (1, 11) of an approximately semicylindrical shape, onto which socks (C), stockings and similar garments can be put and kept in open position;

hooking means (4, 5) for strengthening the hold of said widener (1) on the garments applied thereto, respectively placed in the back part of the widener (1) and above the lateral walls of the same;

handles (7) allowing the use of the device according to the present invention, linked to stiff rods (8) hinged on joints (9) or other equivalent means connected by means of pins (10) or other equivalent means to said widener;

one or more releasing tension ribbons (6) for determining the release of the garments from the corresponding hooking means (4, 5), wherein said tension ribbons (6) are connected to the back hooking means (4) and, optionally, to upper hooking means (5), and cooperate directly with the garment for making the same to overtake said hooking means (4, 5) when the user pulls them.

2. A device according to claim 1, wherein the widener (1) comprises rounded top ends (2) and one or more longitudinal slits (3).

3. A device according to claim 1, wherein the rods (8) linked to the handles (7) have a structural telescopic shape.

4. A device according to claim 1, wherein the widener (11) is specific for containing elastic stockings, and is provided with shapes (12) for strengthening the hold on the mentioned garments (C) thus determining the opening of the upper edge (B) of the same, and is provided with a reinforcement element (13).

5. A self-operated device for the disabled for putting on stockings or socks and similar garments, comprising:

a widening unit (1, 11) of a approximately semicylindrical shape defining a front end, a back end, and side walls, the widening unit being constructed and arranged to (i) receive a sock (C) overlaid in a direction from the front end to the back end, and (ii) maintain the sock (C) in an open position via the side walls;

at least one first hooking unit (5) attached to the side walls of the widening unit (1, 11), the at least one first hooking unit being constructed and arranged to hook a top side of an opening of the sock (C);

at least one second hooking unit (4) attached to the back end of the widening unit (1, 11), the at least one second hooking unit being constructed and arranged to hook a bottom side of the opening of the sock (C);

at least one stiff rod (8) pivotably attached to the back end of the widening unit (1, 11) along an axis substantially perpendicular to the direction from the front end to the back end at least one first tension ribbon (6) attached to a the at least one second hooking unit (4), the at least one first tension ribbon being constructed and arranged to, when pulled, directly push against and unhook the bottom side of the opening of sock (C) from the at least one second hooking unit (4).

6. The device according to claim 5, further comprising at least one second tension ribbon (6) attached to a the at least one first hooking unit (4), the at least one second tension ribbon being constructed and arranged to, when pulled, directly push against and unhook the top side of the opening of sock (C) from the at least one first hooking unit (4).

* * * * *

UNITED STATES PATENT AND TRADEMARK OFFICE

CERTIFICATE OF CORRECTION

PATENT NO. : 8,393,503 B2
APPLICATION NO. : 13/000190
DATED : March 12, 2013
INVENTOR(S) : Giuseppe Moscato It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 123 days.

Signed and Sealed this
First Day of September, 2015

Michelle K. Lee

Michelle K. Lee
*Director of the United States Patent and Trademark Office*